US010148047B2

(12) United States Patent
Wimmer et al.

(10) Patent No.: US 10,148,047 B2
(45) Date of Patent: Dec. 4, 2018

(54) GUIDED COAXIAL CONNECTOR

(71) Applicants: Rosenberger Hochfrequenztechnik GmbH & Co. KG, Fridolfing (DE); Huber+Suhner AG, Herisau (CH); Radiall S.A., Aubervilliers (FR)

(72) Inventors: Martin Wimmer, Palling (DE); Florian Fraunhofer, Traunstein (DE); Josef Krautenbacher, Fridolfing (DE); Franz Manser, Herisau (CH); Claude Brocheton, Coublevie (FR)

(73) Assignees: Rosenberger Hochfrequenztechnik GmbH & CO. KG, Fridolfing (DE); Huber+Suhner AG, Herisau (CH); Radiall S.A., Aubervilliers (FR)

( * ) Notice: Subject to any disclaimer, the term of this patent is extended or adjusted under 35 U.S.C. 154(b) by 0 days.

(21) Appl. No.: 15/743,733

(22) PCT Filed: Apr. 18, 2017

(86) PCT No.: PCT/EP2017/000494
§ 371 (c)(1),
(2) Date: Jan. 11, 2018

(87) PCT Pub. No.: WO2017/178118
PCT Pub. Date: Oct. 19, 2017

(65) Prior Publication Data

US 2018/0205191 A1 Jul. 19, 2018

(30) Foreign Application Priority Data

Apr. 15, 2016 (DE) ..... 10 2016 004 709
May 30, 2016 (DE) ..... 10 2016 006 598

(51) Int. Cl.
*H01R 9/05* (2006.01)
*H01R 24/40* (2011.01)
(Continued)

(52) U.S. Cl.
CPC ..... *H01R 24/40* (2013.01); *H01R 9/05* (2013.01); *H01R 13/5219* (2013.01);
(Continued)

(58) Field of Classification Search
CPC ..... H01R 9/05; H01R 9/0506; H01R 9/0515; H01R 13/52; H01R 13/5202;
(Continued)

(56) References Cited

U.S. PATENT DOCUMENTS 5,074,809 A * 12/1991 Rousseau ..... H01R 24/44 439/578
6,267,621 B1 * 7/2001 Pitschi ..... H01R 24/564 439/578
(Continued)

FOREIGN PATENT DOCUMENTS

EP 0080845 1 A 6/1983
EP 2304851 B1 4/2012
EP 2615699 A1 7/2013

*Primary Examiner* — Chandrika Prasad
(74) *Attorney, Agent, or Firm* — David P. Dickerson

(57) ABSTRACT

The invention relates to a connector having a first coaxial connector having first and third guide surfaces and a second coaxial connector having second and fourth guide surfaces wherein, in a first partially mated condition, the third guide surface contacts the fourth guide surface and the first and second guide surfaces do not contact each other, and wherein, in a second partially mated condition, the first and third contact surfaces contact the second and fourth guide surfaces, respectively, and an outer conductor of the first coaxial connector and an outer conductor of the second coaxial connector do not contact each other.

13 Claims, 7 Drawing Sheets

(51) Int. Cl.

| | |
|---|---|
| ***H01R 24/38*** | (2011.01) |
| ***H01R 13/52*** | (2006.01) |
| ***H01R 13/627*** | (2006.01) |
| ***H01R 13/631*** | (2006.01) |
| *H01R 103/00* | (2006.01) |

(52) U.S. Cl.
CPC ..... *H01R 13/6277* (2013.01); *H01R 13/631* (2013.01); *H01R 24/38* (2013.01); *H01R 2103/00* (2013.01)

(58) Field of Classification Search
CPC ..... H01R 13/5219; H01R 13/6277; H01R 13/631; H01R 24/38; H01R 24/40; H01R 24/50; H01R 24/54; H01R 24/545
USPC ..... 439/578–585, 587
See application file for complete search history.

(56) References Cited

U.S. PATENT DOCUMENTS

| | | | | |
|---|---|---|---|---|
| 7,294,023 | B2 * | 11/2007 | Schneider | H01P 1/045 439/675 |
| 9,236,694 | B2 * | 1/2016 | Binder | H01R 13/629 |
| 2008/0254668 | A1 | 10/2008 | Rosenberger | |
| 2011/0130048 | A1 * | 6/2011 | Haunberger | H01R 24/40 439/660 |
| 2014/0322970 | A1 | 10/2014 | Binder | |

* cited by examiner

GUIDED COAXIAL CONNECTOR

BACKGROUND OF THE INVENTION

Field of the Invention

The invention relates to a plug connector, in particular high-frequency coaxial connector.

Description of the Related Art

A similar plug connector is known for example from EP 2 304 851 B1. The outer conductor contacts may be formed as resilient contact elements. However, such outer conductor contacts can be easily damaged during a joining process in which the first connector is connected to the second connector by means of a joining movement, in particular if the first connector is not oriented exactly in alignment with the second connector.

BRIEF SUMMARY OF THE INVENTION

It is an aim of the present invention to improve the interconnection or joining-together of the first connector with the second connector of a plug connector.

In light of this background, the present disclosure teaches a connector as recited in independent claim 1. Further embodiments are recited in the dependent claims.

For this purpose, in the case of a plug connector of the above-stated type, it is provided that the first connector has a further, third guide surface for guiding the second connector by interaction with a further fourth guide surface of the second connector as the first connector is being joined together with the second connector. In this way, an improvement of the aligned guidance of the first and second connectors as the first connector is being plugged together with the second connector is achieved.

The first guide surface and the first outer conductor contacts section of the first connector are arranged spaced apart from one another in an axial direction with respect to a longitudinal axis of the plug connector, and the second guide surface and the second outer conductor contact section of the second connector are arranged spaced apart from one another in an axial direction with respect to the longitudinal axis of the plug connector.

This has the advantage that, as a result of interaction of the first guide surface with the second guide surface, the second connector has a predetermined position and orientation relative to the first connector during the joining-together process. Accordingly, misalignments during the joining-together process are avoided; such misalignments could otherwise lead to damage to the outer conductor contacts. As a result of the spacing of the first guide surface and of the first outer conductor contact section and also of the second guide surface and of the second contact section, the outer conductor contacts are in this case protected in a targeted manner during the joining process.

In one embodiment, the first guide surface and the first outer conductor contact section are formed as identically oriented surfaces with a respective surface normal vector, wherein the surface normal vectors of the two surfaces have in each case at least one component perpendicular to the longitudinal axis of the plug connector, which components are directed radially in an identical manner. A normal vector is to be understood to mean a vector which is orthogonal, that is to say at right angles or perpendicular, to a plane or surface. A straight line that said vector has as a directional vector is referred to as normal. An oriented surface is to be understood to mean a surface for which it has been defined which of its two sides is the outer or inner side. The orientation of a surface is defined through the selection of one of the two possible surface normal vectors. The outer side of the surface is that from which the selected normal vector leads away. It is thus possible to achieve particularly good guidance with simultaneously functionally reliable contacting of the outer conductor parts.

In a further embodiment, the first guide surface and the first outer conductor contact section are formed as radially outwardly oriented surfaces, wherein the surface normal vectors of the two surfaces have in each case at least one component perpendicular to the longitudinal axis of the plug connector, which components are directed radially outward. It is thus possible to achieve particularly good guidance with simultaneously functionally reliable contacting of the outer conductor parts with a particularly simple construction.

In a further embodiment, the first guide surface is formed on an outer surface of the first outer conductor part and the second guide surface is formed on an inner surface of the second outer conductor part. Thus, the first and the second guide surface form an inner and outer surface pair. The plug connector can thus have a particularly simple construction.

In a further embodiment, the first guide surface is a cylindrical-shell-shaped surface of the first outer conductor part and the second guide surface is a cylindrical-shell-shaped surface of the second outer conductor part. Particularly well-aligned guidance is provided by means of the respective cylindrical-shell-shaped form of the two guide surfaces.

In a further embodiment, the further, third guide surface is formed by an inner surface of an axially displaceable sleeve on the first connector, and the fourth guide surface is formed by an outer surface on the second outer conductor part. It is thus possible to provide a plug connector having a third and fourth guide surface with a particularly simple construction.

In a further embodiment, the third guide surface is a cylindrical-shell-shaped inner surface and the fourth guide surface is a cylindrical-shell-shaped outer surface. A particularly well-aligned second guide is provided by means of the respective cylindrical-shell-shaped form of said two guide surfaces.

In a further embodiment, the first guide surface of the first connector and the second guide surface of the second connector are arranged and designed such that, as the first connector is being joined together with the second connector, firstly the first guide surface and the second guide surface are mechanically contacted, and subsequently, as the first connector is joined together further with the second connector, the first contact section mechanically and electrically contacts the second contact section. Particularly good protection of the outer conductor contact sections during the plug-together process is thus achieved. It is ensured in this way that first and second connectors are oriented in alignment with one another before the outer conductor contact sections mechanically and electrically contact one another.

In a further embodiment, the first outer conductor part and the first outer conductor contact section are formed in one piece and/or in a materially integral manner. It is thus possible to provide a plug connector which can be produced particularly easily.

In a further embodiment, the first outer conductor contact section is a component which is separate from the first outer conductor part and which is pressed into the first outer conductor part. An optimization of the first outer conductor contact section with regard to material characteristics is thus possible independently of the first outer conductor part.

In a further embodiment, the first guide surface is formed on an additional sleeve which is pressed onto the first outer conductor part. It is thus possible to realize an optimization of the first guide surface with regard to material characteristics independently of the first outer conductor part.

The invention also includes a first connector and a second connector for a plug connector of said type.

BRIEF DESCRIPTION OF THE DRAWINGS

The invention will be discussed in more detail below on the basis of the drawing, in which.

DETAILED DESCRIPTION OF THE INVENTION

Figure 1:
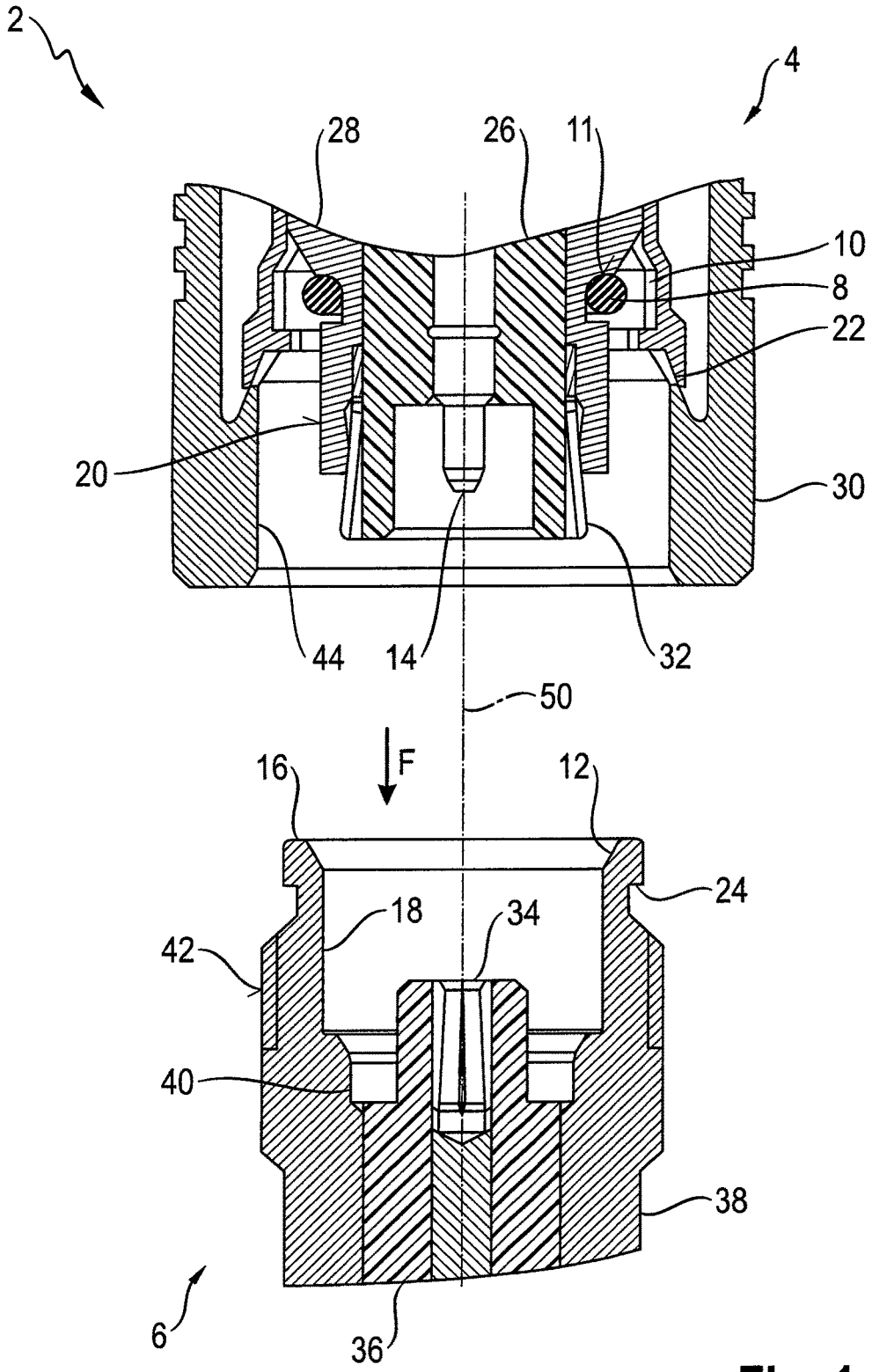
FIG. 1 is a schematic illustration of an exemplary embodiment of a plug connector according to the invention in an exploded illustration.

Reference is made firstly to FIG. 1.

The illustration shows a plug connector 2 having a first connector 4 and a second connector 6.

The plug connector 2 is, in the present exemplary embodiment, a coaxial plug connector and high-frequency plug connector, wherein the first connector 4 can be connected together with the second connector 6 through the formation of a detent interconnection.

Such coaxial plug connectors or coaxial detent plug connectors are also referred to as quick-lock connectors or push-pull connectors.

Coaxial plug connectors serve for the releasable interconnection of coaxial cables. Coaxial plug connectors are, like coaxial cables, of coaxial design in order that they have the advantages of the coaxial cable, specifically low electromagnetic interference and radiation and good electrical shielding and an impedance which corresponds to that of the connected coaxial cable in order to avoid reflections at the transition point between coaxial plug connector and coaxial cable. A coaxial cable, also referred to for short as coax cable, is to be understood here to mean a bipolar cable with a concentric construction which has an inner conductor (also referred to as core) which is surrounded, with a constant spacing, by a hollow cylindrical outer conductor. The outer conductor shields the inner conductor from electromagnetic interference radiation. An insulator or dielectric is arranged in the intermediate space between the inner conductor and the outer conductor.

In the present exemplary embodiment, the first connector 4 is formed as a plug, whereas the second connector 6 is formed as a socket. Furthermore, in the present exemplary embodiment, the first connector 4 and the second connector 6 are each formed as coaxial connectors, for example as a coaxial plug and as a coaxial socket.

The first connector 4 has a first inner conductor part 14, which in the present exemplary embodiment is formed by an inner conductor contact pin which is surrounded by a first insulating part 26. In the present exemplary embodiment, the first insulating part 26 has a substantially cylindrical basic shape, in particular hollow cylindrical basic shape, and is inserted into a first outer conductor part 28 which, in the present exemplary embodiment, likewise has a substantially cylindrical basic shape, in particular hollow cylindrical basic shape, and is inserted into an axially displaceable sleeve 30 which, in the present exemplary embodiment, has a substantially cylindrical basic shape, in particular hollow cylindrical basic shape.

The first outer conductor part 28 may be manufactured from an electrically conductive material and thus form a section of an outer conductor of the plug connector 2. It is thus, in the present exemplary embodiment, formed as a plug guide body. The sleeve 30 may form an outer housing of the first connector 4 and simultaneously have the function of an unlocking element, by means of which the detent interconnection between the first connector 4 and the second connector 6 can be released. In the present exemplary embodiment, the first outer conductor part 28 likewise has a substantially cylindrical basic shape, in particular hollow cylindrical basic shape, and, in the present exemplary embodiment, a groove or shoulder 10. In the present exemplary embodiment, the groove or shoulder 10 provides a planar section which forms a first surface 11 which, as will be discussed further below, effects a compression of a seal 8 which is partially inserted into, or is supported in, the groove or shoulder 10. The seal 8 may for example be an O-ring. Furthermore, the first outer conductor part 28 has, on its outer side, a detent element 22 for forming a detent interconnection with the second connector 6, as will also be discussed in more detail further below. In the present exemplary embodiment, the detent element 22 is a resilient detent hook for a counterpart detent element 24, formed as a detent surface, on the second connector 6. Furthermore, the first connector 4 has a first outer conductor contact section 32 which, in the present exemplary embodiment, is formed by a plug outer conductor contact which is arranged partially between the first insulating part 26 and the first outer conductor part 28 and which has a free contact surface, for example in the form of contact fingers.

Furthermore, in the present exemplary embodiment, the first connector 4 has a first guide surface 20 which interacts with a second guide surface 18 of the second connector 6, as will be described in detail further below. The first guide surface 20 is for example an outer surface. In the present exemplary embodiment, the outer surface is a cylindrical shell outer surface. Furthermore, the first guide surface 20 is arranged spaced apart from the first outer conductor contact section 32 in an axial direction with respect to a longitudinal axis 50 of the plug connector 2. In the present exemplary embodiment, the first guide surface 20 is formed on an outer surface of the first outer conductor part 28.

Furthermore, the first guide surface 20 and the first outer conductor contact section 32 are formed as radially outwardly oriented surfaces.

In the present exemplary embodiment, the first connector 4 has a third guide surface 44 for interacting with a fourth guide surface 42 of the second connector 6, as will likewise be discussed in more detail further below. The third guide surface 44 is formed by an inner surface of the sleeve 30 on the first connector 4. Furthermore, in the present exemplary embodiment, the third guide surface 44 is a cylindrical shell inner surface.

The second connector 6 has a second inner conductor part 34 which corresponds to the first inner conductor part 14 and which, in the present exemplary embodiment, is formed as an inner conductor contact socket and has a substantially cylindrical basic shape, in particular hollow cylindrical basic shape, and is surrounded by a second insulating part 36. The second insulating part 36 likewise has, in the present exemplary embodiment, a substantially cylindrical basic shape, in particular hollow cylindrical basic shape, and is inserted into a main body which in the present exemplary embodiment is of substantially cylindrical form, in particular hollow cylindrical form, for example a second outer conductor part 38. The second outer conductor part 38 may be manufactured from an electrically conductive material and thus form a section of the outer conductor of the plug connector 2.

Furthermore, the second connector 6 has the second guide surface 18 and a second outer conductor contact section 40 which, in the present exemplary embodiment, is formed by a socket outer conductor contact and has a free contact surface. In the present exemplary embodiment, the second guide surface 18 and the second outer conductor contact section 40 of the second connector 6 are spaced apart from one another in an axial direction with respect to the longitudinal axis 50 of the plug connector 2.

Furthermore, the second guide surface 18 is formed on an inner surface of the second outer conductor part 38 and, in the present exemplary embodiment, the second guide surface 18 is a cylindrical-shell-shaped surface of the second outer conductor part 38.

The fourth guide surface 42 is formed by an outer surface on the second outer conductor part 38.

The second outer conductor part 38 has, on a face-side end 16, a second surface 12 which is formed as a 45° bevel in the present exemplary embodiment. Thus, in the present exemplary embodiment, the second surface 12 is formed and arranged such that, as a result of interaction with the first surface 11, the seal 8 elastically deformed axially in the direction of the longitudinal axis 50 of the plug connector 2 and radially inward. In the present exemplary embodiment, the second surface 12 is arranged on an inner surface of the second outer conductor part 38.

Furthermore, in the present exemplary embodiment, the second outer conductor part 38 has, on the face-side end 16, a counterpart detent element 24 which is arranged opposite the second surface 12. In the present exemplary embodiment, the counterpart detent element 24 is arranged on an outer surface of the second outer conductor part 38.

Not shown in the illustration is a securing sleeve or sleeve nut with thread, for example with an M10×0.75 thread, for the additional securing of the plug connector 2.

Figure 1C:
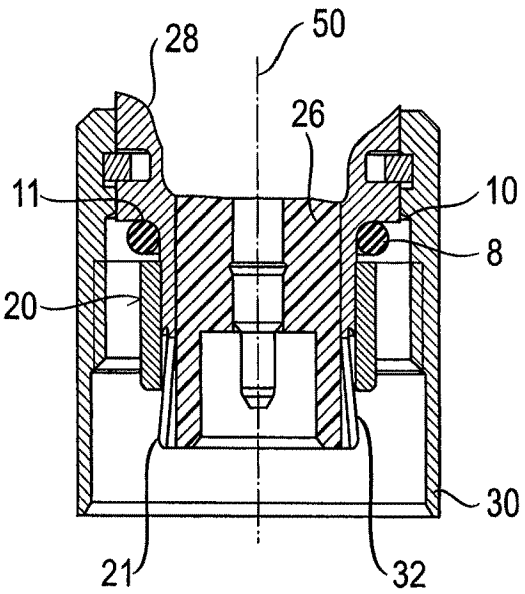
FIG. 1*c* is a schematic illustration of a third exemplary embodiment of a first connector of the plug connector illustrated in FIG. 1.
Figure 1A:
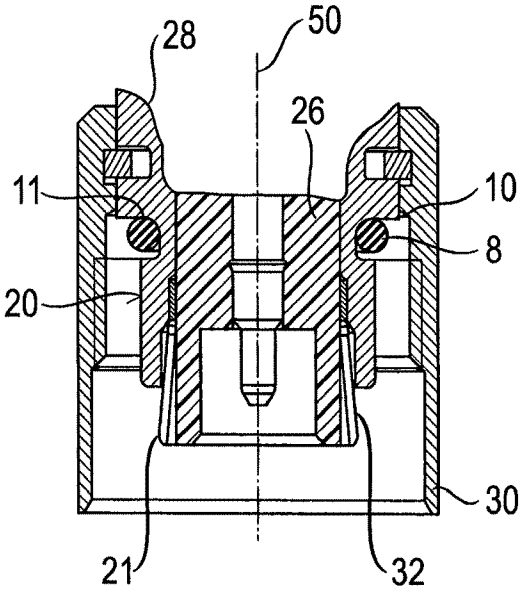
FIG. 1*a* is a schematic illustration of a first exemplary embodiment of a first connector of the plug connector illustrated in FIG. 1.
Figure 1B:
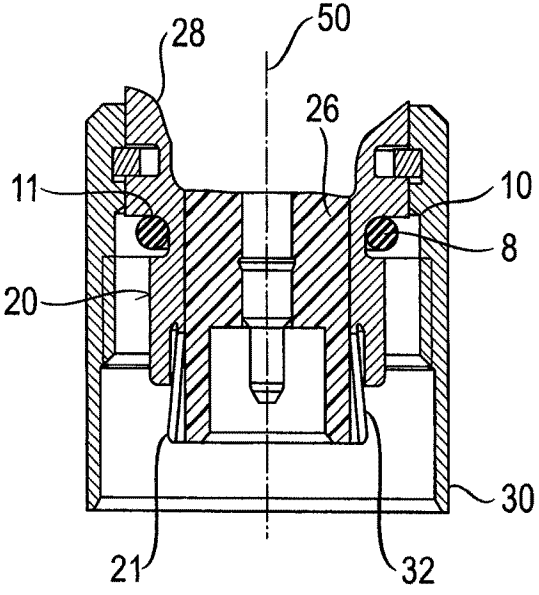
FIG. 1*b* is a schematic illustration of a second exemplary embodiment of a first connector of the plug connector illustrated in FIG. 1.

Reference will now additionally also be made to FIGS. 1*a* to 1*c*.

It is illustrated in FIG. 1*a* that the first outer conductor contact section 32 is formed by a separate component. In the present exemplary embodiment, the separate component is a sleeve 21 which is formed as a spring cage with resilient contact tongues.

By contrast, it is illustrated in FIG. 1*b* that the first outer conductor part 28 together with the sleeve 21, which has the spring cage with resilient contact tongues, of the first outer conductor contact section 32 are formed in one piece and in a materially integral manner.

It is illustrated in FIG. 1*c* that the sleeve 21 is at least partially surrounded by the first guide surface 20 which is formed as a separate element. The first guide surface 20 is pressed onto the first outer conductor part 28 and the sleeve 21.

Reference will now additionally also be made to FIGS. 2 to 6.

Figure 2:
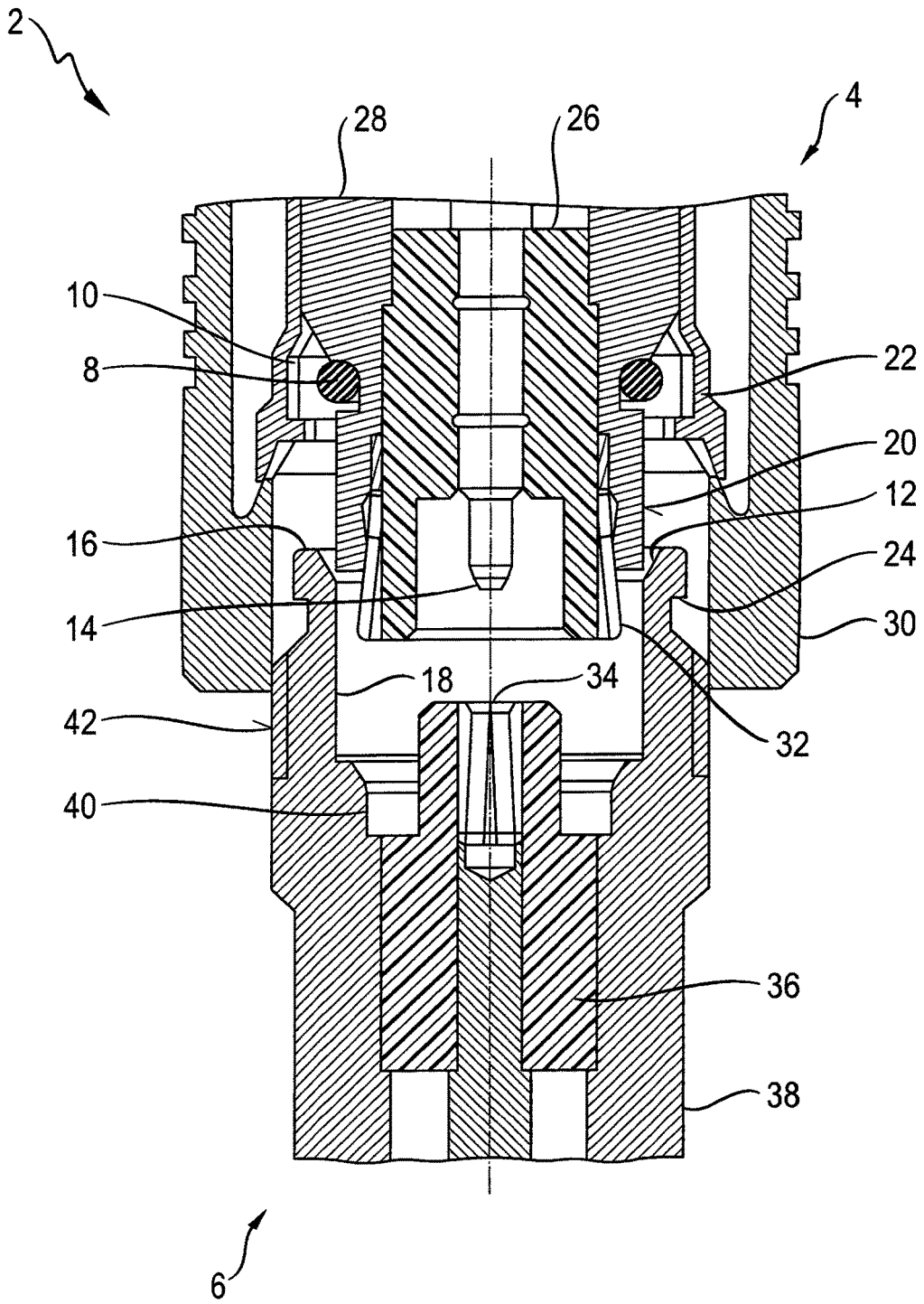
FIG. 2 is a schematic illustration of a first step for the interconnection of the first connector to the second connector.

FIG. 2 shows a first step of the assembly of the plug connector 2, in which the first connector 4 is moved toward the second connector 6 in a joining direction F (see FIG. 1), by means of an axial plugging-in movement along the longitudinal axis 50 of the plug connector 2, until said first connector and second connector come into contact.

The second outer conductor part 38 enters the sleeve 30. It can be seen that the second guide surface 18 of the second outer conductor part 38 comes into contact with the first guide surface 20 of the first outer conductor part 28. Furthermore, in the present exemplary embodiment, the fourth guide surface 42 of the second outer conductor part 38 simultaneously comes into contact with the third guide surface 44 of the sleeve 30. Alternatively, the fourth guide surface 42 of the second outer conductor part 38 and the third guide surface 44 of the sleeve 30 may precede or follow the second guide surface 18 of the second outer conductor part 38 and the first guide surface 20 of the first outer conductor part 28.

The first guide surface 20 of the first outer conductor part 28 forms, together with the second guide surface 18, in the present exemplary embodiment the inner surface of the second outer conductor part 38, a first guide for guiding the second connector 6 as the first connector 4 is being joined together further with the second connector 6. Owing to the respective cylindrical-shell-shaped form, the first guide forms a first cylindrical guide.

Furthermore, the third guide surface 44 of the sleeve 30 forms, together with the fourth guide surface 42, in the present exemplary embodiment an outer surface of the second outer conductor part 38, a second guide for guiding the second connector 6 as the first connector 4 is being joined together further with the second connector 6. Owing to the respective cylindrical-shell-shaped form, the second guide forms a second cylindrical guide.

Figure 3:
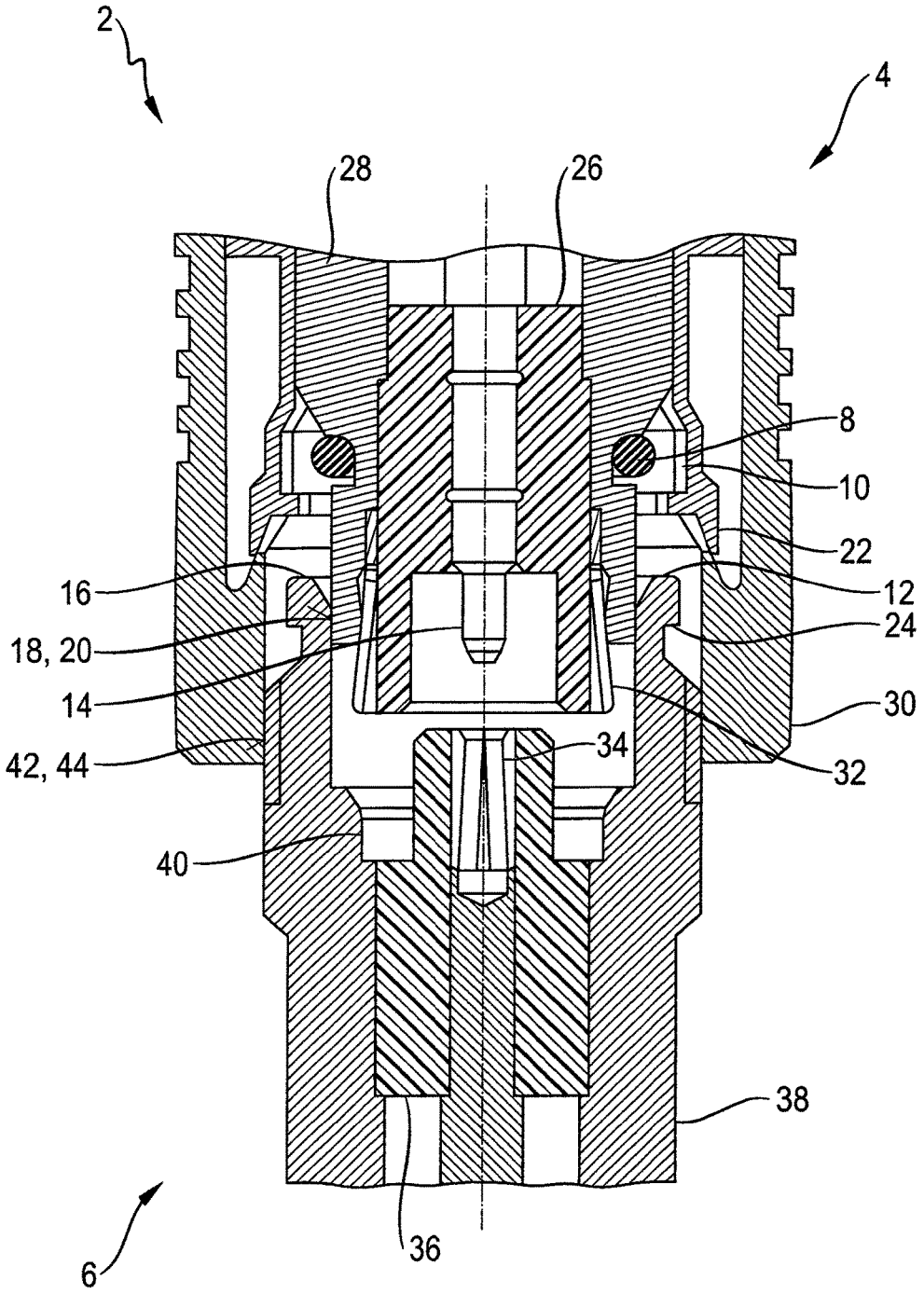
FIG. 3 is a schematic illustration of the continuation of the joining process illustrated in FIG. 1.

FIG. 3 illustrates a continuation of the joining movement.

Figure 4:
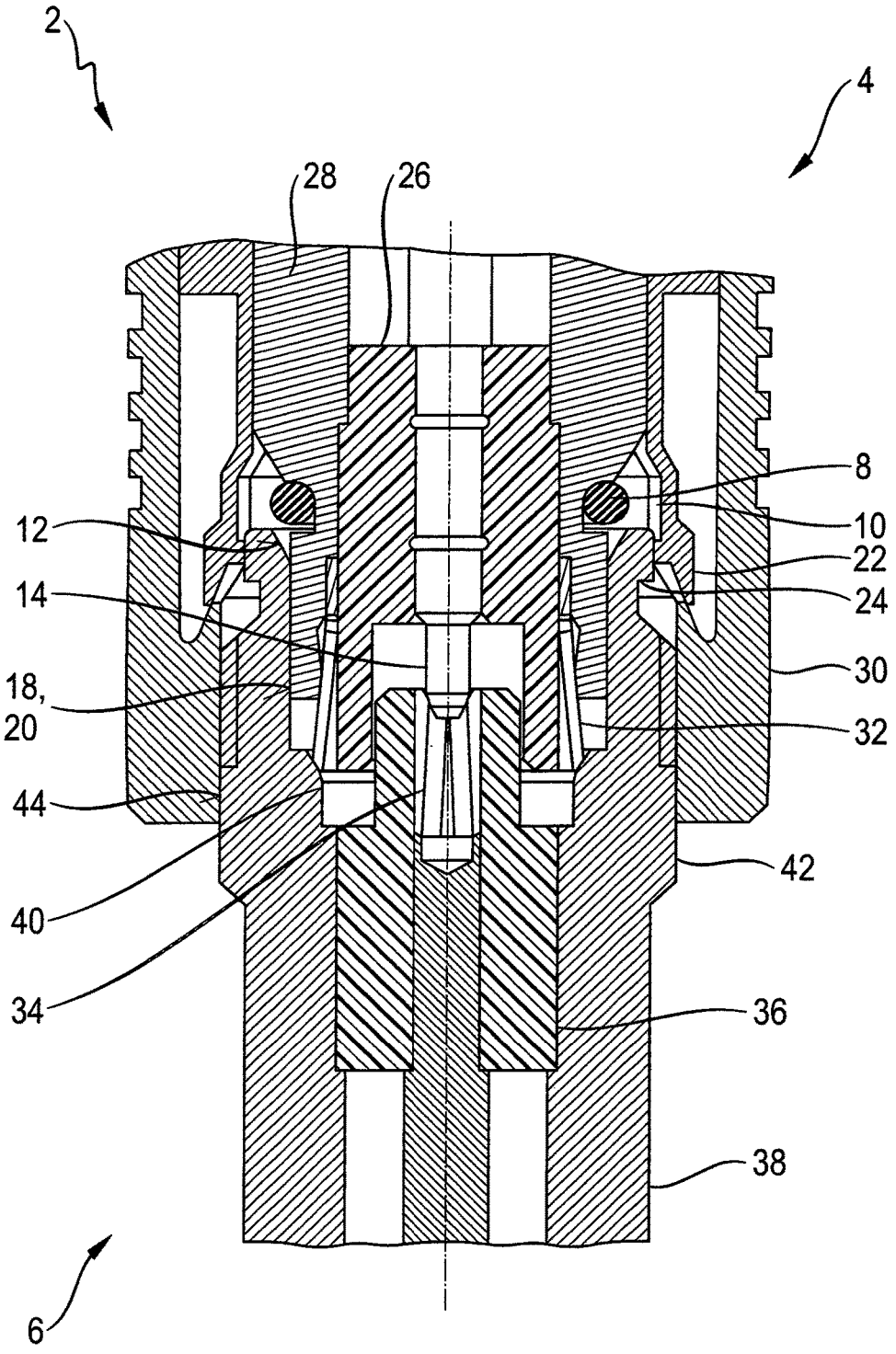
FIG. 4 is a schematic illustration of a second step for the interconnection of the first connector to the second connector.

FIG. 4 illustrates a second step. Now, the first inner conductor part 14 enters the second inner conductor part 34 and thus forms an inner conductor. Furthermore, the free contact surface of the first outer conductor contact section 32 of the first outer conductor part 28 comes into electrical and mechanical contact with the second outer conductor contact section 40 of the second outer conductor part 38, and thus forms an outer conductor.

It is thus the case that the second guide surface 18 and the first guide surface 20 of the first guide and also the third guide surface 44 and the fourth guide surface 42 of the second guide come into mechanical contact before the electrical contacts, specifically the first inner conductor part 14 and the second inner conductor part 34 and also the first outer conductor contact section 32 and the second outer conductor contact section 40. In other words, the guides of the plug connector 2 precede its electrical contacts.

Figure 5:
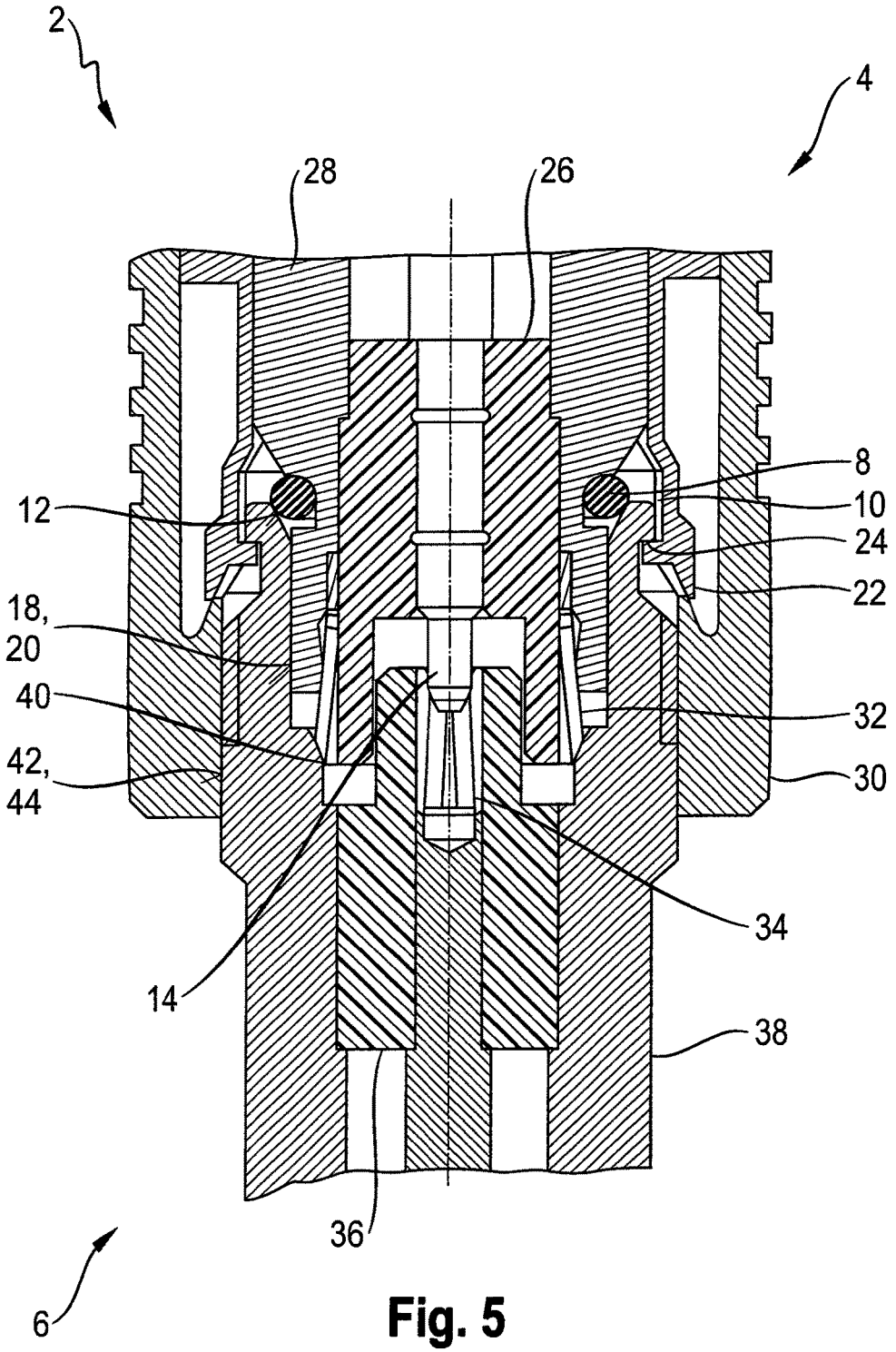
FIG. 5 is a schematic illustration of a third step for the interconnection of the first connector to the second connector.

FIG. 5 illustrates a third step. After the second surface 12 has reached the seal 8 which is supported on the first surface 11, the detent element 22 is also elastically deflected in a radial direction.

As a result, by continuation of the joining movement in an axial direction along the longitudinal axis 50 (joining direction F, see FIG. 1), the seal 8 is compressed until the detent element 22 passes in a radial direction out of engagement with the counterpart detent element 24 and can snap back again in the radial direction.

Furthermore, as a result of the form of the second surface 12 as a bevel, the seal 8 is compressed radially inward. Thus, the seal 8 is secured in its position, and the friction between the second surface 12 and the seal 8, on the one hand, and the friction between the first surface 11 and the seal 8, on the other hand, prevent twisting of the second connector 6 as a result of a rotation about the longitudinal axis 50.

Figure 6:
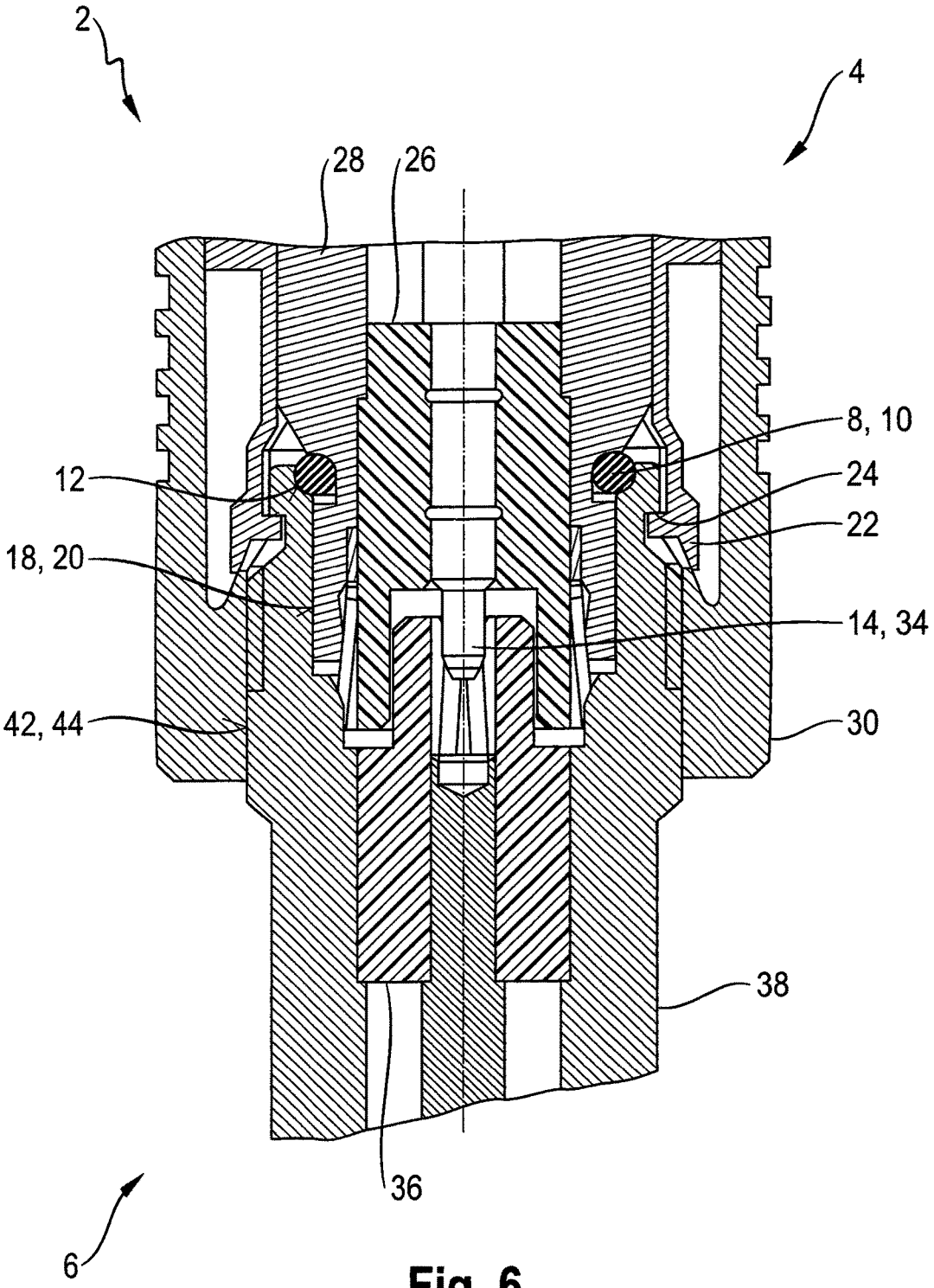
FIG. 6 shows the plug connector illustrated in FIG. 1 in the assembled state.

FIG. 6 illustrates the fully assembled plug connector 2. After the end of the joining movement and the withdrawal of the joining force, the seal 8 expands slightly and pushes the second connector 6 in a direction opposite to the direction of the joining movement F (see FIG. 1), for example by 0.05 mm to 0.4 mm. The compressed seal 8 provides a restoring force which pushes the first connector 4 and the second connector 6 apart. Thus, the detent element 22 and the counterpart detent element 24 come into contact in an axial direction and are secured by the contact pressure which acts in an axial direction owing to the compression of the seal 8. Furthermore, in this way, play is eliminated, that is to say the interconnection is free from play in an axial direction.

Thus, by means of the interaction of the first guide surface 20 with the second guide surface 18 of the first guide and of the third guide surface 44 with the fourth guide surface 42 of the second guide, misalignments during the joining-together process are avoided; such misalignments could otherwise lead to damage to the first outer conductor contact section 32.

The invention claimed is:

1. A pluggable connector comprising:

a first connector; and a second connector, said first connector comprising a first inner conductor, a first outer conductor and a first insulating portion, said first insulating portion supporting said first inner conductor radially inward of and coaxially to said first outer conductor, said second connector comprising a second inner conductor, a second outer conductor and a second insulating portion, said second insulating portion supporting said second inner conductor radially inward of and coaxially to said second outer conductor, said first outer conductor comprising a first outer conductor contact portion and a first guide surface, said first guide surface being parallel to a longitudinal axis of said first connector, said second outer conductor comprising a second outer conductor contact portion and a second guide surface, said second guide surface being parallel to a longitudinal axis of said second connector, said first connector defining a third guide surface parallel to said longitudinal axis of said first connector, said second connector defining a fourth guide surface parallel to said longitudinal axis of said second connector, in a first partially mated configuration of said first connector and said second connector, said third guide surface guidingly contacts said fourth guide surface, and said first guide surface does not contact said second guide surface, in a second partially mated configuration of said first connector and said second connector, said first guide surface guidingly contacts said second guide surface, said third guide surface guidingly contacts said fourth guide surface, and said first outer conductor contact portion does not contact said second outer conductor contact portion, in a mated configuration of said first connector and said second connector, said first guide surface guidingly contacts said second guide surface, said third guide surface guidingly contacts said fourth guide surface, and said first outer conductor contact portion electrically and mechanically contacts said second outer conductor contact portion.

2. The pluggable connector of claim 1, wherein:

said first outer conductor contact portion is resiliently deflectable in a radial direction.

3. The pluggable connector of claim 1, wherein:

said first guide surface is a radially outward facing surface of said first outer conductor, and said second guide surface is a radially inward facing surface of said second outer conductor.

4. The pluggable connector of claim 1, wherein:

said first guide surface is a cylindrical outer surface of said first outer conductor, and said second guide surface is a cylindrical inner surface of said second outer conductor.

5. The pluggable connector of claim 1, wherein:

said first connector comprises an axially displaceable sleeve, said third guide surface is a radially inward facing surface of said sleeve, and said fourth guide surface is a radially outward facing surface of said second connector.

6. The pluggable connector of claim 5, wherein:

said third guide surface is a cylindrical outer surface of said sleeve, and said fourth guide surface is a cylindrical inner surface of said second connector.

7. The pluggable connector of claim 5, wherein:

said sleeve is situated radially outward of said first outer conductor.

8. The pluggable connector of claim 5, wherein:

said sleeve is displaceable in a direction parallel to said longitudinal axis of said first connector.

9. The pluggable connector of claim 1, wherein:

in said first partially mated configuration, said third guide surface electrically and mechanically contacts said fourth guide surface.

10. The pluggable connector of claim 1, wherein:

in said second partially mated configuration, said first guide surface electrically and mechanically contacts said second guide surface, and said third guide surface electrically and mechanically contacts said fourth guide surface.

11. The pluggable connector of claim 1, wherein:

in said mated configuration, said first guide surface electrically and mechanically contacts said second guide surface, and said third guide surface electrically and mechanically contacts said fourth guide surface.

12. The pluggable connector of claim 1, wherein:

an element constituting said first guide surface is separably distinct from an element constituting said first outer conductor contact portion.

13. The pluggable connector of claim 1, wherein:

said first guide surface and said first outer conductor contact portion are constituent elements of a single piece of material.

* * * * *